US007300254B2

(12) United States Patent
Kistner et al.

(10) Patent No.: US 7,300,254 B2
(45) Date of Patent: Nov. 27, 2007

(54) CEILING FAN BLADE WITH DECORATIVE INSERT

(75) Inventors: Terry Lee Kistner, 2675 Calle Pera, Thousand Oaks, CA (US) 91360; Jason Allen Kirkelis, Westlake Village, CA (US); Kenneth Lee Kistner, Moorpark, CA (US)

(73) Assignee: Terry Lee KistnerCA (US)

( * ) Notice: Subject to any disclaimer, the term of this patent is extended or adjusted under 35 U.S.C. 154(b) by 115 days.

(21) Appl. No.: 11/121,338

(22) Filed: May 3, 2005

(65) Prior Publication Data

US 2006/0018755 A1 Jan. 26, 2006

Related U.S. Application Data

(60) Provisional application No. 60/567,939, filed on May 4, 2004.

(51) Int. Cl.
*F03B 3/12* (2006.01)

(52) U.S. Cl. ..... 416/210 R

(58) Field of Classification Search ..... 416/146 R, 416/210 R, 227 R, 241 A
See application file for complete search history.

(56) References Cited

U.S. PATENT DOCUMENTS

| | | | | | |
|---|---|---|---|---|---|
| 925,031 | A | * | 6/1909 | Russel | 416/204 R |
| D256,614 | S | | 8/1980 | Hoyt | D23/411 |
| 4,832,572 | A | | 5/1989 | Prucha et al. | 416/146 R |
| 5,028,206 | A | * | 7/1991 | Kendregan et al. | 416/5 |
| 5,082,422 | A | | 1/1992 | Wang | 416/5 |
| D324,565 | S | * | 3/1992 | Fraser | D23/411 |
| D341,881 | S | | 11/1993 | Smith et al. | D23/411 |
| 5,281,093 | A | | 1/1994 | Sedlak et al. | 416/62 |
| 5,338,156 | A | | 8/1994 | Chien | 416/132 A |
| 5,341,565 | A | | 8/1994 | Kuryliw | 416/5 |
| D361,124 | S | | 8/1995 | Pearce | D23/328 |
| 5,458,464 | A | | 10/1995 | Lee | 416/210 R |
| 5,470,205 | A | | 11/1995 | Conklin, Jr. | 416/205 |
| 5,516,264 | A | | 5/1996 | Anetrini | 416/62 |
| 5,564,900 | A | | 10/1996 | McAuley | 416/62 |
| 5,591,006 | A | | 1/1997 | DeMeo et al. | 416/62 |
| 5,601,409 | A | | 2/1997 | Huang | 416/229 R |
| 5,722,814 | A | | 3/1998 | Yu | 416/204 R |
| 5,795,131 | A | | 8/1998 | Crowhurst et al. | 416/146 R |
| D407,814 | S | | 4/1999 | Lin | D23/413 |
| 5,944,486 | A | | 8/1999 | Hodgkins, Jr. | 416/210 R |
| 5,947,686 | A | | 9/1999 | Keyes | 416/61 |
| 6,015,261 | A | | 1/2000 | Barone | 416/62 |
| 6,019,479 | A | | 2/2000 | Barker | 362/96 |
| 6,079,947 | A | | 6/2000 | Gabriel et al. | 416/229 R |
| 6,155,787 | A | | 12/2000 | Hodgkins, Jr. | 416/210 R |
| D453,219 | S | | 1/2002 | Godfrey | D23/411 |

* cited by examiner

*Primary Examiner*—Edward K. Look
*Assistant Examiner*—Nathan Wiehe

(57) ABSTRACT

An improved transparent blade for a ceiling fan that includes a decorative insert is disclosed. The complete blade assembly provides a blade support, screw holes, and a blade field, which contours the interior area of the topside of the blade. The blade provides an open cavity area for easy and secure insertion and removal of a decorative insert which can be viewed by the room occupant through the clear bottom side of the blade field. The fixed blade is a single, durable, relatively thin flat member manufactured from injection-molded plastic. The present invention offers a fashionable appearance and adds value to a room's setting and ambience.

8 Claims, 5 Drawing Sheets

30

16
16

16
16

16
16
16
30
16

CEILING FAN BLADE WITH DECORATIVE INSERT

CROSS REFERENCE TO RELATED APPLICATIONS

Applicants claim the benefit under 35 U.S.C. 119(e) of U.S. provisional application 60/567,939, filed on May 4, 2004.

BACKGROUND OF THE INVENTION

1. Field of the Invention

The present invention pertains to the following areas of technology: Environmental Heating and Cooling, Fluid Handling and Sanitary Equipment; Fluid Reaction Surfaces, i.e. Impellers.

2. Description of the Prior Art

A standard blade for a ceiling fan is constructed of solid wood or plywood. The highest quality blades are seven ply, furniture quality. Most blades, however, are multply wooden blades with photo finishes. Custom decorative fan blades are also known in the art. They are available in various shapes, sizes and materials.

SUMMARY AND OPERATION OF THE INVENTION

The present invention is a transparent blade for attachment to a ceiling fan. Most ceiling fans have five blades. The blades can be part of an original ceiling fan sold at retail, or the blades can be sold as after market product kits to modify or upgrade an existing installed ceiling fan. Each blade is attached to one of the arms extending from the ceiling fan. The blade is design to allow the user to insert a decorative insert so that the room occupant can view the decorative insert. The inserts are easily removable and interchangeable. Printing of various kinds would be available based on consumer interests and demand. The themes are limitless. The printed decorative design could include professional sports teams and logos, colleges and their logos, college athletic teams and logos, holiday themes, children's first names, company names and logos, special occasion themes such as birthdays and weddings, geographic names and locations, drawings, photos, artistic designs and the like.

DETAILED DESCRIPTION OF THE INVENTION

An improved transparent blade plate for a ceiling fan that includes a decorative insert is disclosed. The blade plate provides blade support, screw holes, and a blade field. The blade plate provides an open cavity area for easy and secure insertion and removal of a decorative insert which can be viewed by the room occupant through the inferior surface of the blade field component of the blade plate. The fixed blade is a single, durable, relatively thin and flat member fabricated from an injection-molded plastic. The present invention offers a fashionable appearance to a ceiling fan and adds value to a room's setting and ambience.

Figure 8:
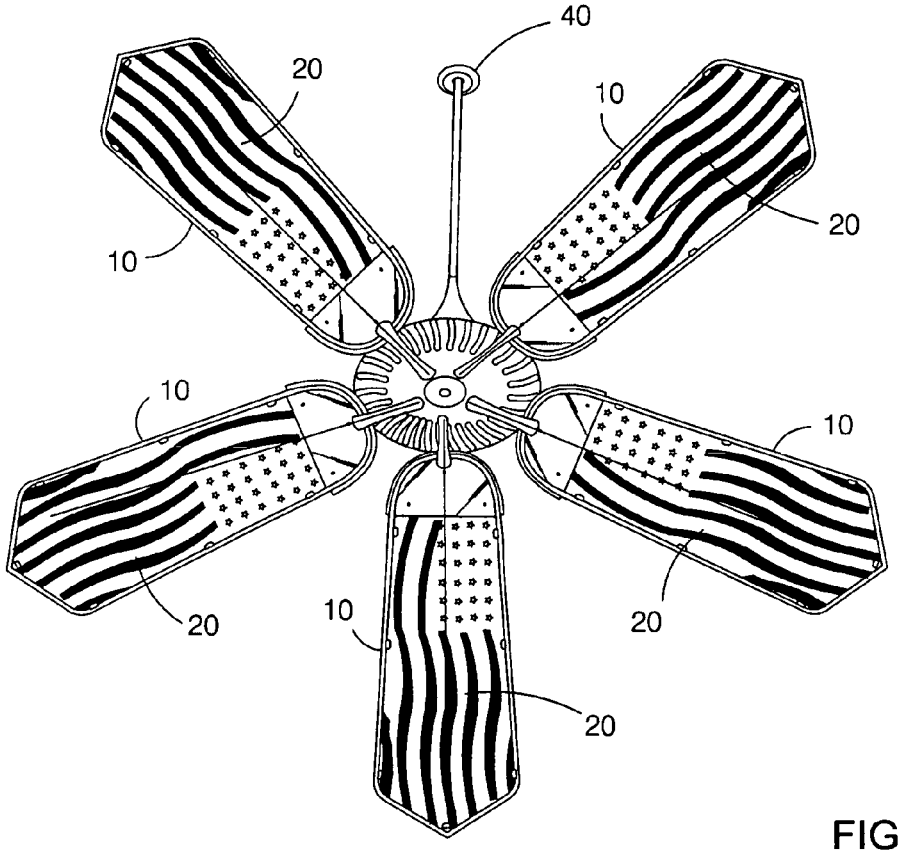
FIG. 8 is a perspective view of a ceiling fan with five blade plates with decorative inserts properly secured in place.
Figures 9, 10, 11, 12, 13:
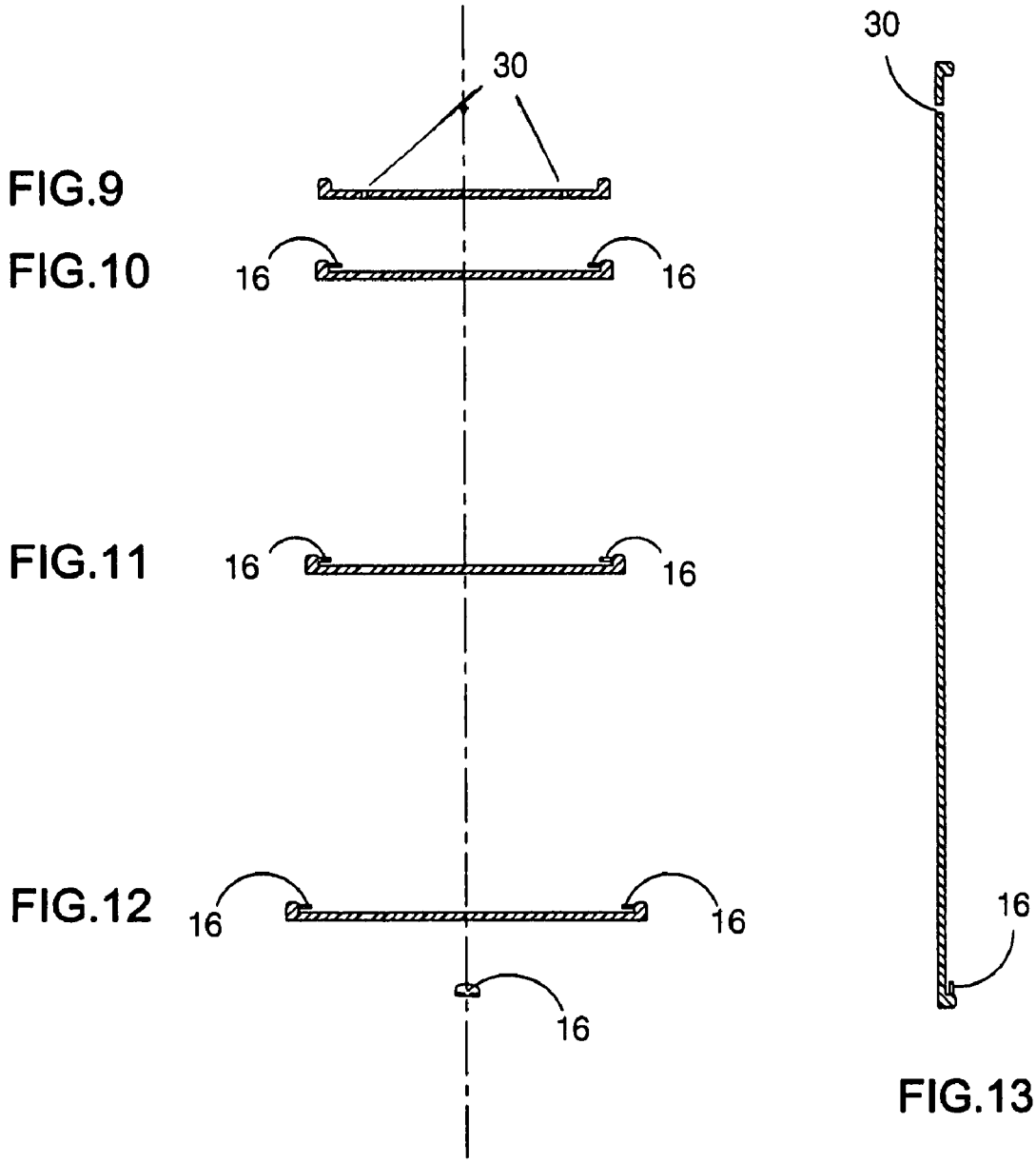
FIG. 9 is a transverse cross-sectional view taken along the line 9-9 in FIG. 2.
FIG. 10 is a transverse cross-sectional view taken along the line 10-10 in FIG. 2.
FIG. 11 is a transverse cross-sectional view taken along the line 11-11 in FIG. 2.
FIG. 12 is a transverse cross-sectional view taken along the line 12-12 in FIG. 2.
FIG. 13 is a longitudinal cross-sectional view taken along the line 13-13 in FIG. 2.

The present invention will now be discussed in detail. FIG. 8 illustrates a ceiling fan 40, a blade plate 10, and a decorative insert 20. The blade plate can also be referred to as a ceiling fan blade.

Figure 1:
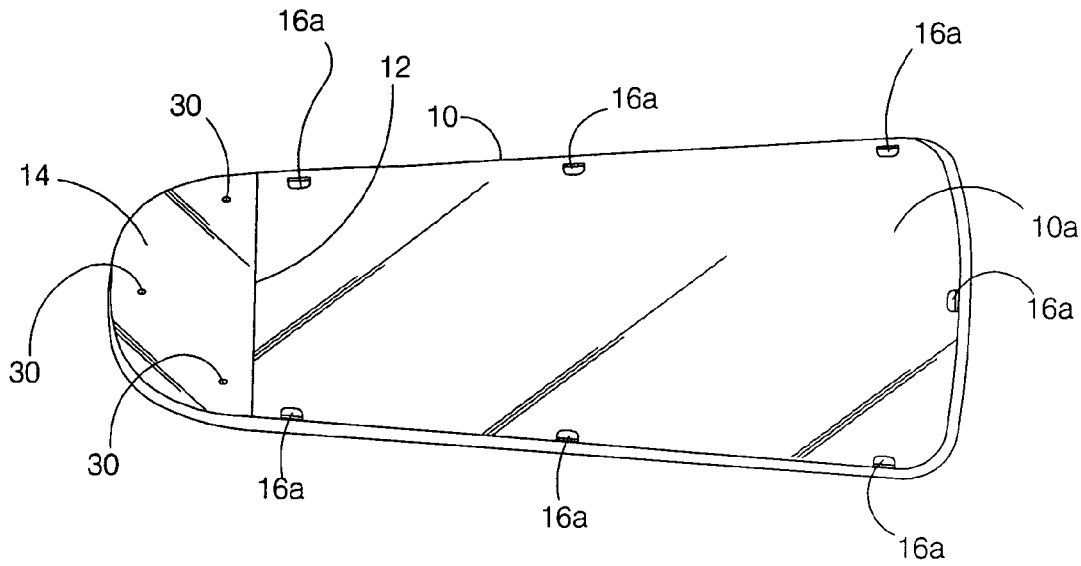
FIG. 1 is a bottom plan view of the blade plate component of the present invention.
Figure 2:
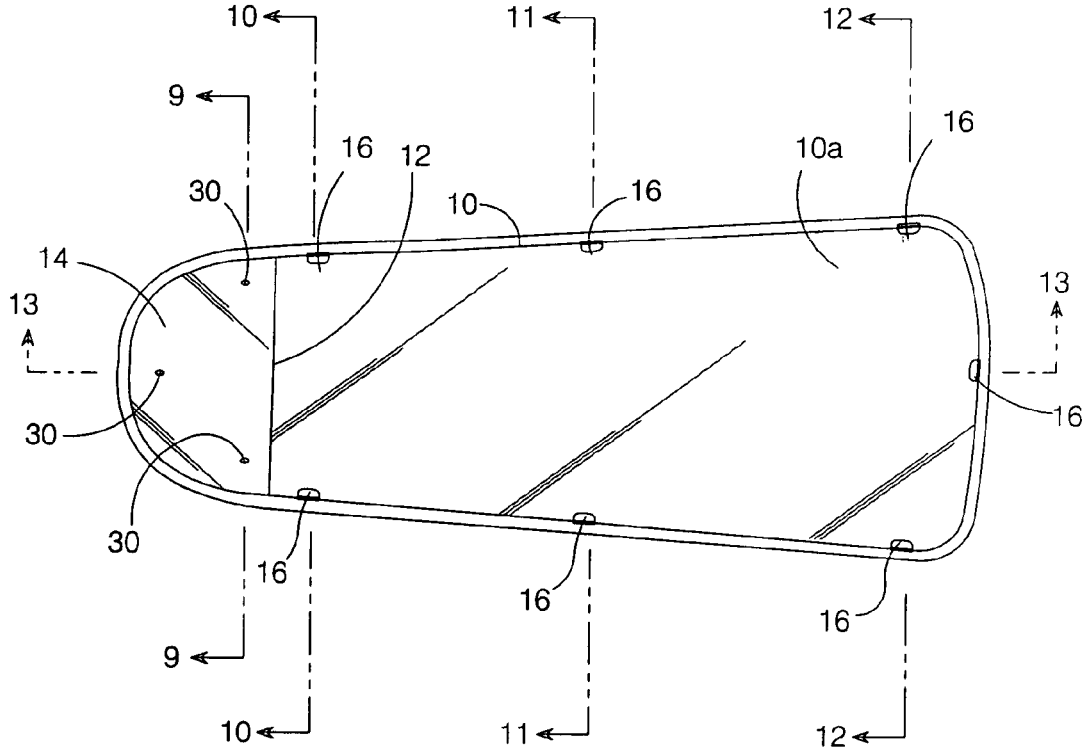
FIG. 2 is a top plan view of the blade plate shown in FIG. 1.
Figure 3:
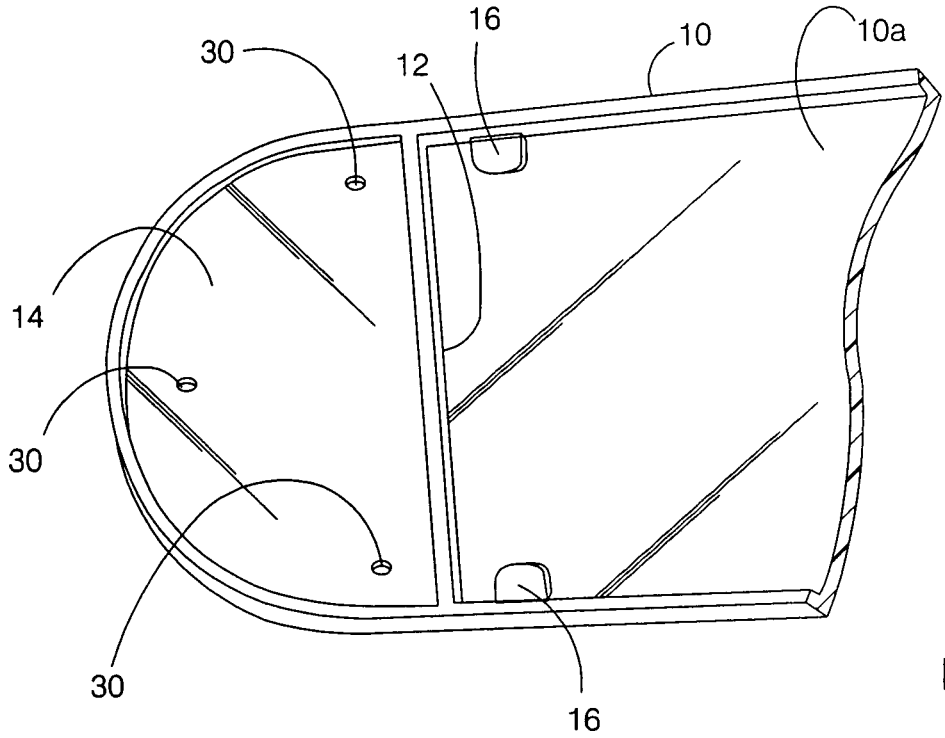
FIG. 3 is an enlarged fragmentary view of the attachment end of the blade plate shown in FIG. 1.
Figure 4:
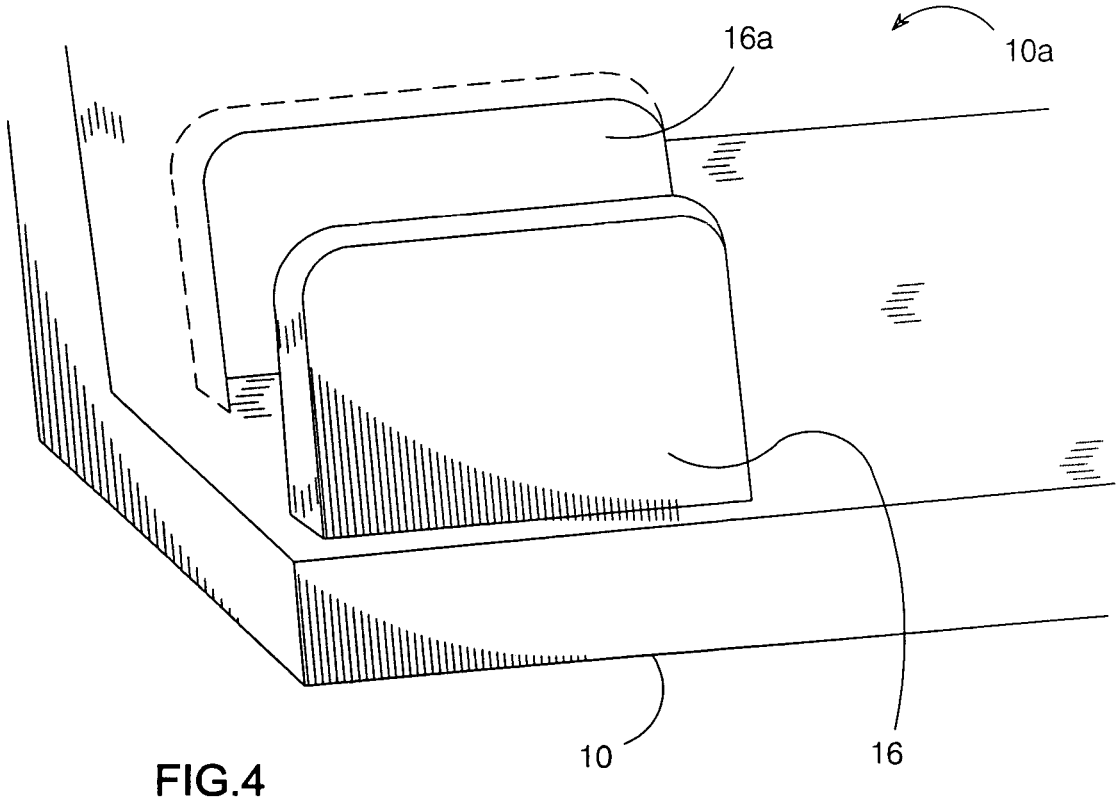
FIG. 4 is an enlarged view of the blade tab and the blade through-hole shown in FIGS. 1, 2 and 3.
Figure 5:
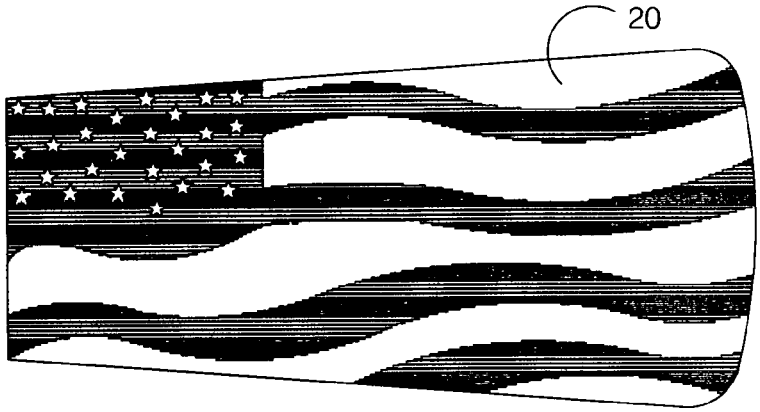
FIG. 5 is a bottom plan view of a decorative insert for insertion in the blade plate.
Figure 6:
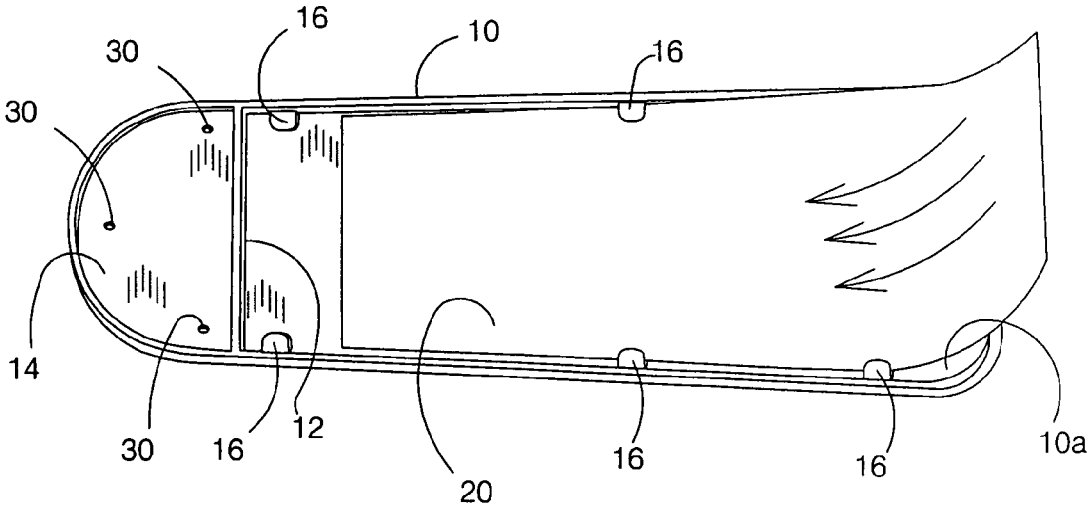
FIG. 6 is a view similar to FIG. 2 showing the decorative insert in FIG. 5 being inserted into the blade plate.
Figure 7:
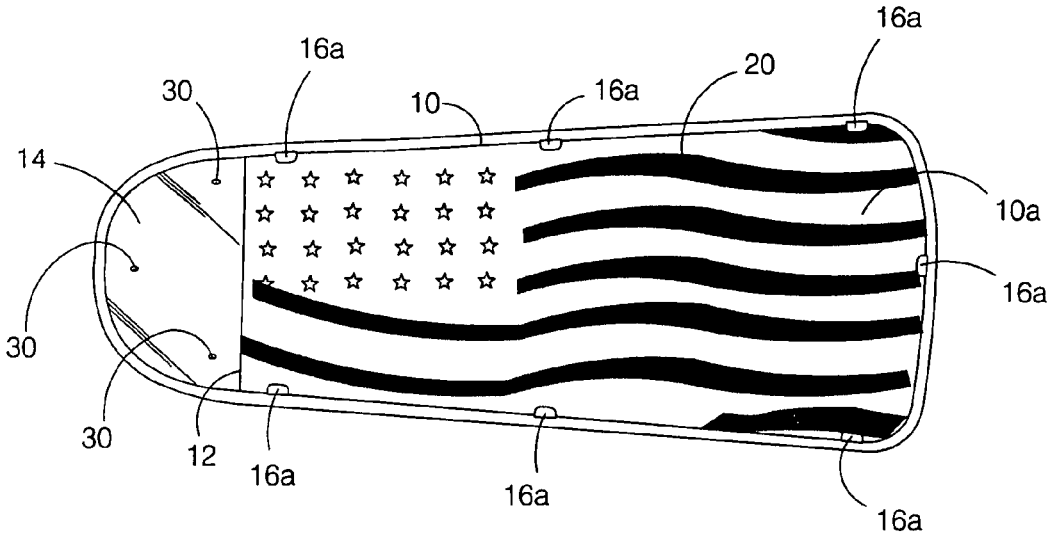
FIG. 7 is a view similar to FIG. 1 after the decorative insert is properly inserted into the blade plate.

FIG. 1 illustrates a bottom plan view of the blade plate 10, and FIG. 2 illustrates the top of the blade plate 10. The blade plate 10 includes an integral blade field 10A and a blade heel 14. An insert stop 12 is transversely positioned on the blade plate 10 for defining and separating the blade field 10A from the blade heel 14. The periphery of the blade field 10A has generally the same dimensions as the outer border of the decorative insert 20. The insert stop 12 abuts with the proximal end of the decorative insert 20 to help maintain the decorative insert 20 in place after insertion as illustrated in FIG. 7. The blade field 10A has a plurality of blade tabs 16 positioned around the inside periphery of the blade field 10A for holding the edges of the decorative insert and keeping the insert 20 in a stationary position after insertion especially when the ceiling fan is in operation. Each blade tab 16 has a blade through-hole 16A which is positioned complementary with the blade tab 16. FIG. 4 is an enlarged view of one of the blade tabs 16 and the complementary blade through-hole 16A. The two have a superposed relationship. A small gap between the two holds a portion of the edge of the decorative insert 20 in place. The combination of the plurality of blade tabs 16, blade through-holes 16A and the insert stop 12 allows for quick and easy insertion or removal of the decorative insert 20. FIG. 6 shows the decorative insert 20 in the process of being inserted into the blade field 10A of the blade plate 10. The proximal end of the decorative insert 20 is slid into place while the edges of the sides and the distal end of the decorative insert 20 are guided underneath the blade tabs 16. The decorative insert 20 is sufficiently flexible to allow the distal portion to be temporarily bent to allow the distal end to fit under the blade tabs at the distal end of the blade plate 10. FIG. 7 shows the end result after the decorative insert 20 is properly inserted into the blade plate 10. The top or superior face of the blade plate 10 faces the ceiling after the blade plate is installed on the arm of the ceiling fan 40. The top surface of the decorative insert 20 is exposed after proper installation and is not visible to a room occupant. The bottom surface of the decorative insert 20 is visible to a room occupant. The decorative insert 20 rests atop the inside of the bottom or inferior surface of the blade field 10A. The blade heel 14 has three screw holes 30 for allowing attachment of the blade plate 10 to the radial arm of a conventional ceiling fan. The screw hole pattern can be changed to adapt to any type of ceiling fan on the market. It is to be understood that the scope of the present invention includes the capability to modify or change the blade heel 14 to accommodate any ceiling fan arm bolt or screw pattern.

In operation, the user inserts the decorative insert into the blade plate according to the following steps: he or she grips the custom blade plate, then the user inserts the decorative insert into the blade plate, then the user attaches the combination decorative insert and blade plate to the arm of a convention ceiling fan.

The user can also remove the decorative insert from the blade plate and replace it with another decorative insert.

While the present invention has been shown and described herein in what is conceived to be the best mode contemplated, it is recognized that departures may be made therefrom within the scope of the invention which is therefore not to be limited to the details disclosed herein, but is to be afforded the full scope of the invention.

What is claimed is:

1. A ceiling fan blade with decorative insert for attachment to a ceiling fan comprising:

a blade plate which includes an integral blade field and a blade heel;

an insert stop being transversely positioned on said blade plate for defining and separating said blade field and said blade heel;

at least one blade tab being positioned around the periphery of said blade field for holding a decorative insert;

a blade through-hole being positioned complementary with at least one said blade tab; and at least one screw hole in said blade heel for allowing attachment of said blade plate to a ceiling fan.

2. The ceiling fan blade as recited in claim 1 further comprising:

a decorative insert for insertion in said blade field.

3. A ceiling fan blade with decorative insert for attachment to a ceiling fan comprising:

a blade plate which includes an integral blade field and a blade heel;

an insert stop being transversely positioned on said blade plate for defining and separating said blade field and said blade heel;

at least one blade tab being positioned around the periphery of said blade field for holding a decorative insert;

a blade through-hole being positioned complementary with said blade tab;

at least one screw hole in said blade heel for allowing attachment of said blade plate to a ceiling fan; and a decorative insert for insertion in said blade field.

4. The ceiling fan blade as recited in claim 3 wherein:

said decorative insert can be removed and replaced with another decorative insert for decorative purposes.

5. The ceiling fan blade as recited in claim 3 wherein said blade plate is fabricated from a clear plastic material.

6. The ceiling fan blade as recited in claim 3 wherein said blade plate is changeable to accommodate various types of ceiling fan arms.

7. A method of inserting a decorative insert into a blade plate and mounting the combination to a conventional ceiling fan comprising the following steps:

gripping a custom blade plate having a plurality of blade tabs with complementary blade through-holes;

inserting a decorative insert into the blade plate by placing the decorative insert under all of the blade tabs having complementary blade through-holes; and attaching the combination decorative insert and blade plate to the arm of a conventional ceiling fan.

8. The method as recited in claim 7 further comprising:

removing the decorative insert from the blade plate and replacing it with another decorative insert.

* * * * *